United States Patent [19]

Glaspie

[11] 4,233,825

[45] Nov. 18, 1980

[54] KNITTING MACHINE

[75] Inventor: Donald L. Glaspie, Dallas, Tex.

[73] Assignee: Glitsch, Inc., Dallas, Tex.

[21] Appl. No.: 903,214

[22] Filed: May 5, 1978

[51] Int. Cl.[2] ..... D04B 35/24; D04B 15/48; D04B 15/88; D04B 35/12

[52] U.S. Cl. ..... 66/125 A; 66/8; 66/132 R; 66/149 R; 66/152; 66/161

[58] Field of Search ..... 66/8, 9 A, 56, 125 A, 66/132 R, 146, 151, 152, 163, 161

[56] References Cited

U.S. PATENT DOCUMENTS

| | | | |
|---|---|---|---|
| 393,010 | 11/1888 | Hill | 66/125 A |
| 393,189 | 11/1888 | Stowe | 66/152 X |
| 577,906 | 3/1897 | Wohlgemuth | 66/146 X |
| 1,039,989 | 10/1912 | Morley | 66/152 X |
| 1,237,106 | 8/1917 | Scott et al. | 66/8 |
| 1,517,992 | 12/1924 | Howie | 66/151 |
| 2,258,421 | 10/1941 | Richter | 66/125 A |
| 2,364,560 | 12/1944 | Stover | 66/9 A |
| 2,696,034 | 12/1954 | Swartz | 66/8 X |
| 3,120,051 | 2/1964 | Spurgeon | 66/125 A |
| 3,303,671 | 2/1967 | Oliver, Jr. | 66/132 R |
| 3,377,824 | 4/1968 | Moyer | 66/132 R |
| 3,939,671 | 2/1976 | Lawson et al. | 66/132 R X |

FOREIGN PATENT DOCUMENTS

| | | | |
|---|---|---|---|
| 992603 | 7/1951 | France | 66/146 |
| 1386488 | 3/1975 | United Kingdom | 6/146 |

*Primary Examiner*—Wm. Carter Reynolds
*Attorney, Agent, or Firm*—Thomas L. Cantrell; Joseph H. Schley

[57] ABSTRACT

Disclosed is an improved knitting machine in which special steps have been taken to provide for close correlation of the operation of the knitting filament in-feed equipment and the knitted fabric out-feed equipment with the speed of the knitting head itself, to produce a more uniform and better quality knitted product, and to reduce the danger of filament or fabric breakage caused by jamming at the knitting head or at one of the pieces of feed equipment. These steps are particularly important in the knitting of wire mesh fabric, because wire filament is less stretchable than most textile filaments and thus less able to compensate for variations in the speed of the various pieces of equipment acting upon it as it passes through the machine. In particular, the filament in-feed equipment, the fabric take-up equipment, and if desired, the fabric take-down equipment, are all driven by power trains which include the knitting head. In addition, the speed of the take-down equipment is made continuously variable to compensate for variations in the rate of delivery of knitted fabric out of the cylinder. Furthermore, a break-away accumulator is preferably provided in the filament feed system to compensate for the stopping time of the knitting head.

11 Claims, 5 Drawing Figures

KNITTING MACHINE

BACKGROUND OF THE INVENTION

Circular knitting machines of the kind which produce a knitted tube of fabric are a well-developed art, and have been used for many years to process textile filament. Such machines have several basic components which act upon the filament and the knitted fabric as they move through the machine: Filament in-feed equipment, the knitting head, the fabric take-down system (which provides the desired knitting tension, a key knitting control parameter), and the fabric take-up system. All of these are power operated and operate at nominally correlated speeds. In practice, however, the correlation of such speeds has heretofore not been particularly precise, nor has the imprecision in correlation been very critical, since most textile fibers, and the resulting knitted fabrics, are resilient or elastic enough to compensate for it. However, the knitting of metallic wire mesh presents a more difficult problem. In such knitting, a relatively high knitting tension is required to form the wire into the desired stitch shapes. This compounds the difficulty presented by the relative lack of stretchability of wire, which makes it prone to breakage if snags develop during knitting, or if the speeds of the components get too far out of correlation, either abruptly or gradually.

SUMMARY OF THE INVENTION

In accordance with the invention, an improved knitting machine is provided in which some, or even all, of the knitting filament and knitted fabric drives are powered through the knitting head. Preferably, this is accomplished by driving the knitting head by a motor equipped with a belt driving a sheave or pulley mounted on the head. Additional sheaves are mounted on the knitting head for rotation therewith. These drive belts running to sheaves connected to other pieces of filament and fabric feed equipment. Thus it can be seen that the knitting head itself is incorporated into the power trains for the feed equipment, since it is functionally the shaft for their drive sheaves. As a consequence, any variation in the speed of the knitting head, regardless of its cause or magnitude, is substantially instantaneously reflected in a corresponding variation in the speed of the feed equipment. In this way frequent wire breakage attributable to overstresses in the wire created by miscorrelation of feed equipment speed and head speed are substantially eliminated.

In accordance with another aspect of the invention, one piece of feed equipment, the knitted fabric tube take-down means, is provided with automatic speed control means adapted to rapidly adjust the take-down speed to maintain the knitting tension at the knitting cylinder at the desired level despite variations in knitting head speed or stitch length. The speed control means are arranged to cut off the take-down means in the event of a knitting head stoppage.

These capabilities are achieved by mounting the take-down rolls on a lever which is mounted on the frame to pivot toward and away from the knitting cylinder, that is, up and down beneath the cylinder. A power drive is provided for the take-down rolls, which may be driven by the main knitting machine motor, either directly or through a power train including the knitting head, as described above, or it may be a separate and independent electric motor. The power drive is provided with a speed control throttle, and the drive is mounted either upon the knitting machine or upon the take-down lever. In the first case, a speed control rod is interposed between the throttle and the take-down lever to operate the throttle to increase roll speed as the lever falls and decrease it as the lever rises. In the second case, a speed control rod is interposed between the throttle and the knitting machine frame to operate the throttle in the same manner.

In accordance with still another aspect of the invention, a break-away accumulator is preferably included in the knitting filament feed system to provide for difference in the quickness with which the knitting head and the filament feeder come to a halt, owing primarily to the differences in their inertias. In addition, the break-away accumulator serves to prevent many wire breakages caused by snags in the filament feed system.

In its preferred form, the break-away accumulator includes two arrays of pulleys spaced from one another. One array is fixed on a frame, while the other is mounted on a block or element slidably mounted on the frame. The slidable block is held in fixed position by detent locking means. The knitting filament is trained around pulleys of one array and then the other on its way to the knitting cylinder. When the tension in the filament exceeds a selected level the detent lock operates to shut off the machine and to free the block slide to move its pulley array close to the fixed pulley array, and thus provides an appreciable amount of slack wire to relieve the tension build-up and prevent breakage of the wire while stopping.

While each of the features of the present invention outlined above is calculated to better fit a circular knitting machine to handle metallic wire filament, it will be appreciated that improved handling of textile filament can also be attained by use of some or all of them.

From the foregoing, it should be clear that the principal object of the present invention is the provision of means for more closely controlling and correlating the forces acting on the filament and fabric moving through a circular knitting machine to prevent breakages and stoppages, and to improve product quality. The manner in which this object is attained, together with other objects and purposes, can best be understood by a consideration of the detailed description which follows, together with the accompanying drawings.

DESCRIPTION OF THE PREFERRED EMBODIMENTS OVERALL ORGANIZATION

Figure 1:
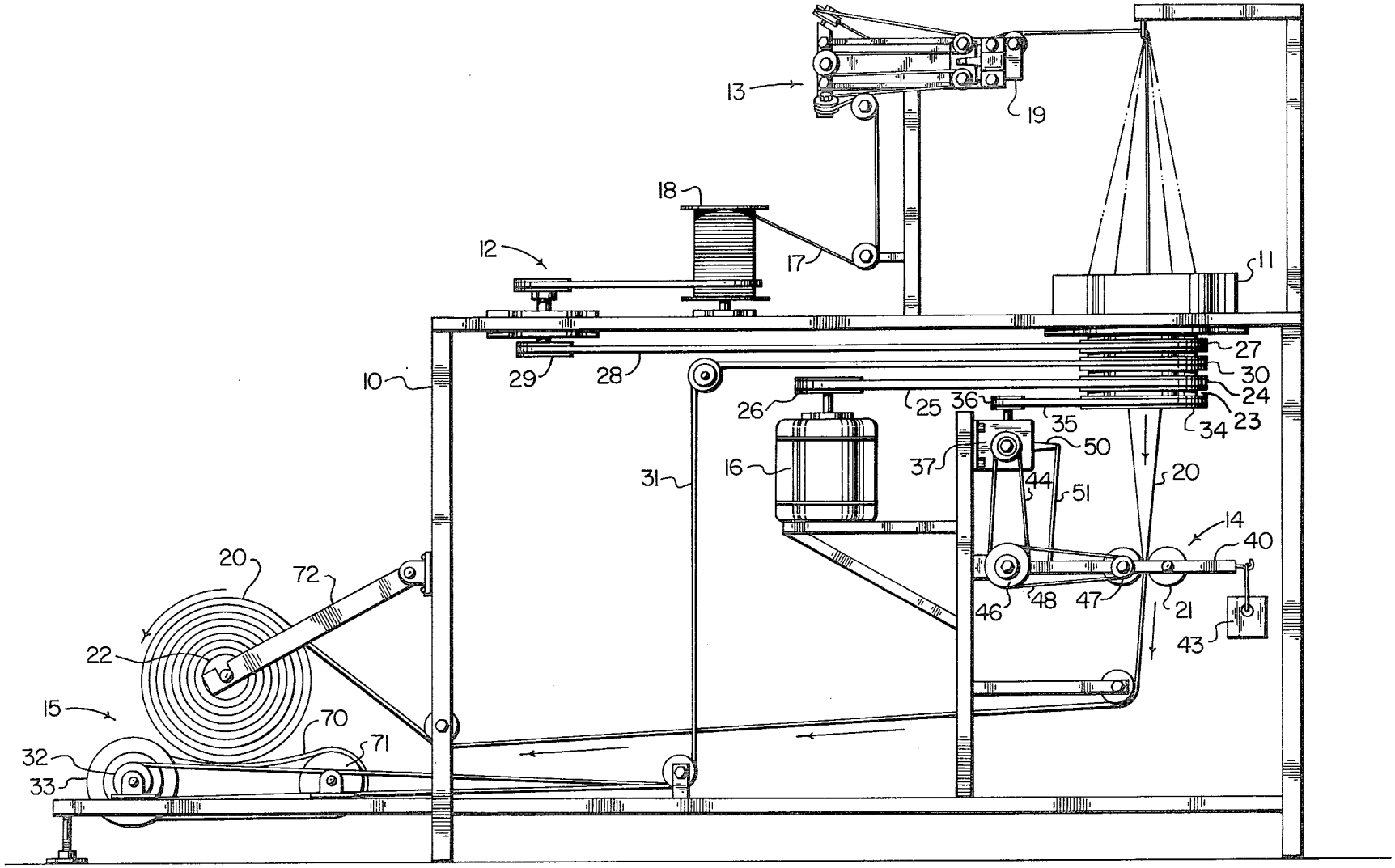
FIG. 1 is a somewhat simplified side elevational view of a circular knitting machine constructed in accordance with the invention.

Attention is first directed to FIG. 1, from which an understanding of the overall organization of the knitting machine of the invention may be obtained. In that FIG., it can be seen that the knitting machine has a frame 10 on which the various basic components are mounted. These include: the knitting head 11 (the detailed structure of which forms no part of the invention and is thus not shown or discussed); the knitting filament supply system 12; the break-away accumulator 13; the knitted fabric tube take-down system 14; the knitted fabric take-up system 15; and the main drive motor 16.

Knitting filament 17 passes from a supply spool 18 through accumulator 13 and adjacent lubricating bath 19 to the knitting head 11. The varied positions of filament 17 being fed to head 11 caused by rotation of the head elements are indicated in FIG. 1 by dashed lines. There, the needles of the head engage the filament and bend and interlock it into stitches in any one of several well-known manners to form a tube 20 of knitted fabric, which issues from the bottom of the cylinder.

The tube 20 is drawn downwardly out of the cylinder by a pair of pinch rolls 21 forming part of the take-down system 14. Rolls 21 flatten tube 20 and preferably crimp or corrugate it also when wire stock is being knitted. The take-down system 14 also provides the desired tension on the wire or filament being knit in the cylinder, such tension being an important knitting parameter influencing stitch tightness, stitch count, and the like.

The flattened tube 20, after leaving pinch rolls 21, is fed to a take-up roll 22 in the take-up system 15, where it is wound up into a roll of convenient size for storage and further handling.

MAIN DRIVE SYSTEM

The main drive system features of the invention can best be appreciated from a consideration of FIG. 1. The rotating portion of knitting head 11 has mounted on its underside a hollow tube or shaft 23 which has an inside diameter large enough to admit passage of knitted tube 20. A drive sheave or pulley 24 is mounted on shaft 23, and is connected by drive belt 25 to a sheave 26 on main motor 16. Thus, in accordance with the invention, the knitting head is driven directly by the main motor, which may be equipped with conventional speed control equipment and safety cut-offs (not shown).

While the knitting head is directly driven by the main motor, it is a feature of the invention that the other systems which act upon the knitting filament and the knitted fabric are not. Instead, they (or some of them) are driven through power trains which include the knitting head 11 and its shaft 23. In this way, any variation in the speed or rotation of the knitting head is immediately reflected in the speed of operation of the other systems, whether the variation is caused by a deliberate or unplanned change in the speed of motor 16, or by a snag or other increase in friction at the knitting cylinder.

In particular, a sheave or pulley 27 mounted on shaft 23 is connected by a drive belt 28 to a sheave 29 in the filament feed system 12. (In those filament feed systems utilizing stationary feed spools this arrangement may be omitted.) Another sheave or pulley 30 is mounted on shaft 23, and is connected by drive belt 31 to a sheave 32 on roller 33 in the take-up system 15. Still another sheave 34 is mounted on shaft 23 and connected by a drive belt 35 to an input sheave 36 on take-down system power means 37. (As is pointed out elsewhere, power means 37 is throttle equipped and may be independently powered or driven directly by motor 16.)

TAKE DOWN SYSTEM

Figure 2:
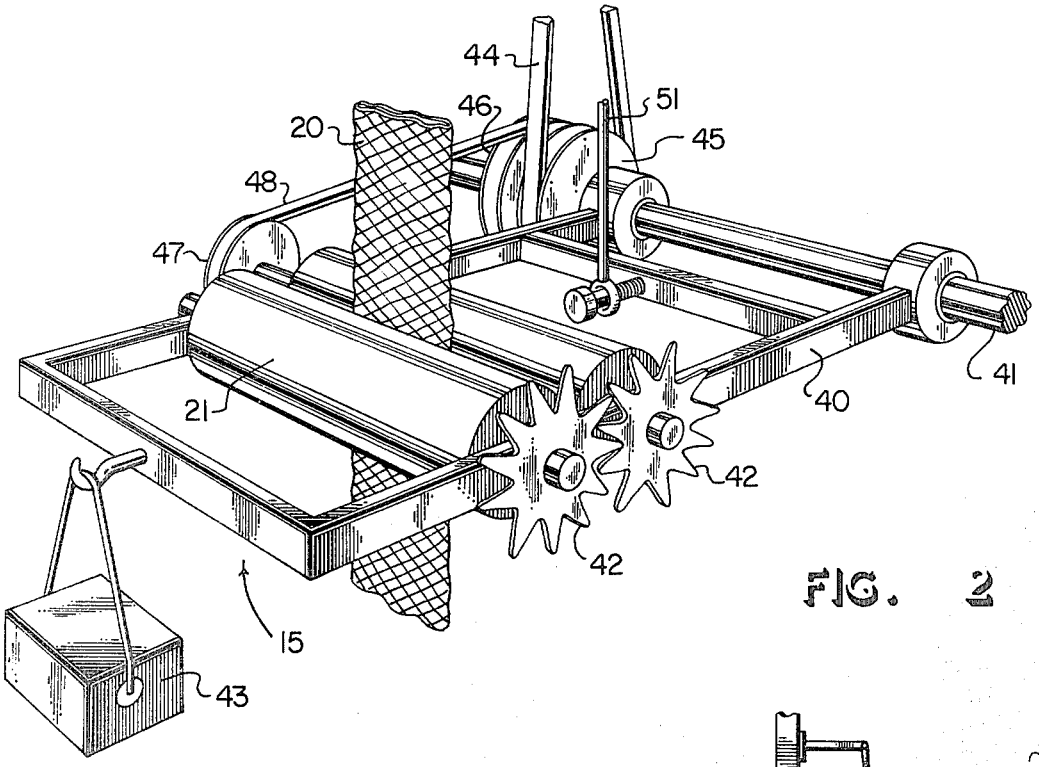
FIG. 2 is a fragmentary perspective view of the take-down rolls and associated apparatus of the machine of FIG. 1 on an enlarged scale.
Figure 3:
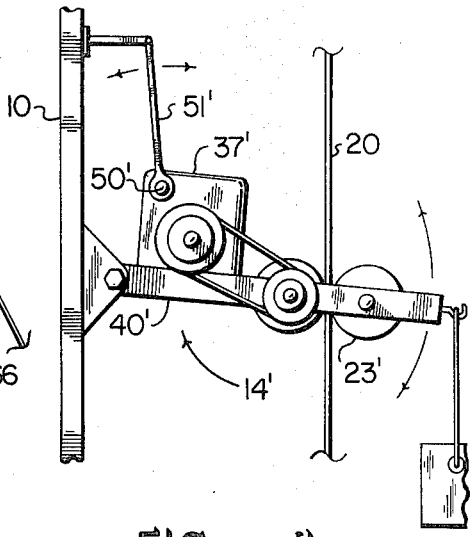
FIG. 3 is a fragmentary side elevational view of alternate form of take-down means constructed in accordance with the invention.

Two embodiments of the take-down means of the invention are disclosed herein. One of these is shown in FIGS. 1 and 2, and the other is shown in FIG. 3. In the first embodiment, take-down system 14 includes a lever 40 which is pivotally mounted on frame 10 to move upwardly toward the knitting head 11 and downwardly away from it as conditions may require. The pivotal mounting is accomplished by means of shaft 41. Lever 40 carries above mentioned pinch rolls 21, which are geared together by gears 42. Preferably the rolls are corrugated or otherwise patterned to improve their grip on knitted tube 20 and to crimp or corrugate the tube, but such corrugations are omitted from the drawings for simplicity.

Lever 40 is biased downwardly away from the knitting head 11 a desired amount by weight 43, which may be of selected size and changed at will to vary the knitting tension.

Pinch rolls 21 are driven by above-mentioned power means 37, acting thru a belt drive power train which includes belt 44 running from the power means to a first sheave 45 on shaft 41, and a second sheave 46 on shaft 41 which is connected to sheave 47 on the pinch rolls by belt 48. As a consequence of this arrangement, the effective length of the pinch roll power train remains unchanged as lever 40 pivots up and down during operation, and belt tensions also remain relatively uniform, enough so to prevent belt slippage.

Power means 37 is of the kind having a throttle or speed control 50, which is connected by control rod 51 to a convenient point on lever 40. By this construction, provision is made to increase the speed of power means 37 and pinch rolls 21 when lever 40 moves downwardly, as will occur when the knitting head delivers tube 20 at a rate greater than the nip speed of the pinch rolls. When the tube 20 issues from the cylinder at a rate slower than the nip speed of the pinch rolls, they tend to "climb up" the tube, raising lever 40 and causing rod 51 to close throttle 50 to slow power means 37 and hence the nip speed to a more appropriate level. When the head stops for any reason, the rising lever 40 causes rod 51 to close throttle 50 completely to bring about a corresponding stoppage in pinch rolls 21.

In the second embodiment of the take-down system 14', shown in FIGS. 3, power means 37' is mounted on lever 40' instead of on frame 10, and drives pinch rolls 23' through a direct belt drive. This arrangement, like the first embodiment discussed above, results in a power train whose length and tension do not change materially as the lever pivots up and down. A control rod 51' is connected between throttle 50' and frame 10 to operate the throttle automatically to increase the nip speed when lever 40' drops and decrease it when lever 40' rises, ultimately stopping the power means 37' when movement of fabric tube 20 stops.

BREAK-AWAY ACCUMULATOR SYSTEM

Figure 4:
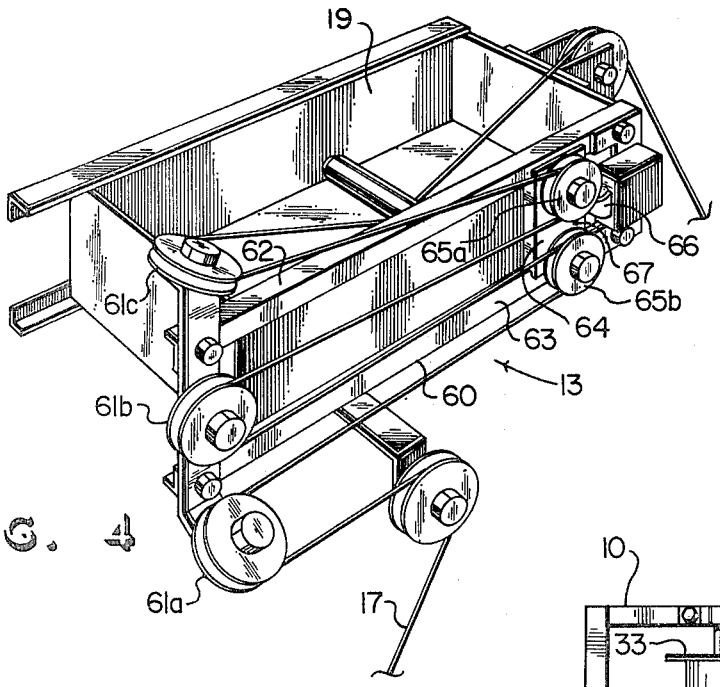
FIG. 4 is a perspective view, on an enlarged scale, of a break-away accumulator constructed in accordance with the invention.
Figure 5:
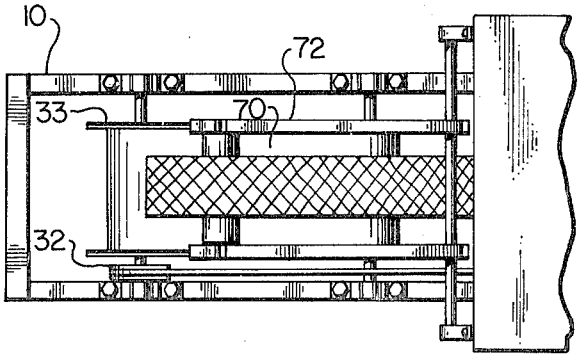
FIG. 5 is a fragmentary plan view of the take-up means of the knitting machine of FIG. 1.

The break-away accumulator of the invention is shown in elevation in FIG. 1 at 13, and in perspective on an enlarged scale in FIG. 4. It forms a desirable part of the knitting filament in-feed system, and is positioned in the flow path of the filament between the supply spool 18 and the knitting head 11. The accumulator is useful in both power driven filament supply systems of the kind shown in FIG. 1 and in filament supply systems of the kind in which the supply spool is fixed and does not rotate.

The break-away accumulator system 13 includes a frame 60, at one end of which is mounted a first array of pulleys 61*a*, 61*b*, 61*c*, that are generally aligned vertically. The horizontal members of frame 60 comprise rails 62, 63. A block 64 is slidably mounted on rails 62, 63, and carries a second array of pulleys 65*a*, 65*b*, which are also generally vertically aligned. Block 64 is normally held on the rails adjacent the end of frame 60 remote from the first array of pulleys by spring finger 66, working in detent 67 in block 64. Knitting filament 17 is trained alternately around the pulleys of one array and then the other, and then into and out of lubricating bath 19, on the side of which frame 60 may conveniently be mounted.

So long as the tension in knitting filament 17 is sufficiently low, the filament runs smoothly from the supply spool, through the arrays of pulleys are just described, into and through the lubricating bath, and to the knitting head 11. When the tension in filament 17 exceeds a selectable value (selected below the breaking point of the filament), spring finger 66 breaks out of detent 67, freeing block 64 to slide toward the first pulley array and stopping the motor through a switch (not shown). The length of filament which was stored dynamically between the pulleys of the two arrays is thus made available as slack to accommodate a momentary difference in the speeds of the knitting head and the filament supply system thus avoiding breakage of the filament. Various conditions can cause such momentary differences in speed. One typically occuring condition arises from the greater mass and inertia of the knitting cylinder which cuases it to stop less abruptly than the filament spool when power is removed. Another such condition is a snag at the filament spool.

The block 64 may be reset with finger 66 engaging detent 67 after the operation just described.

KNITTED FABRIC TAKE-UP SYSTEM

The knitted fabric take-up or wind-up system of the invention appears in elevation in FIG. 1 and in plan in FIG. 4. It comprises sheave 32, driven by belt 31, driving roller 33, over which is trained endless belt 70. Belt 70 is also trained over idler roller 71. A pivotally mounted arm 72 is mounted on frame 10 carries take-up roll 22, on which tube 20 is wound-up in successive layers by reason of the frictional contact between belt 70 and the wound up portion of tube 20.

I claim:

1. A knitting machine comprising:

a frame;

a knitting head and cylinder mounted on said frame in position to receive knitting filament fed thereto from above said cylinder and to deliver a tube of knitted fabric downwardly out of said cylinder;

take-down means mounted on said frame below said cylinder for tensioning said knitted tube and drawing it downwardly out of said cylinder;

take-up means mounted on said frame for receiving said knitted tube from said take-down means and winding it up into a roll;

knitting filament feed means mounted on said frame for feeding knitting filament to said knitting cylinder;

power means mounted on said frame for operating said knitting machine;

power train means connecting said power means to said knitting head, said knitting head to said take-up means, and said knitting head to said knitting filament feed means, whereby variations in knitting head speed are instantaneously compensated for by variations in the speed of said feed and take-up means;

said take-down means comprising:

a lever pivotally mounted on said frame;

a variable speed drive means having a throttle;

a pair of pinch rolls mounted on said lever for engaging said knitted tube and drawing it downwardly out of said cylinder;

a pulley and belt system interconnecting said drive means and said pinch rolls;

means for variably biasing said pinch rolls away from said cylinder; and means for operating said drive means throttle to increase the speed of said drive means upon downward excursions of said throttle and decrease the speed of said drive means upon upward excursions of said throttle.

2. A knitting machine in accordance with claim 1 in which said power train means further comprises means connecting said knitting head to said take-down means.

3. A knitting machine in accordance with claim 1 in which at least part of said power train comprises pulleys mounted coaxially of said knitting head for rotation therewith and belts working in said pulleys.

4. A knitting machine in accordance with claim 1 in which said variable speed drive means is mounted on said lever and in which said throttle operating means comprises a rod connected to said throttle and pivotally connected to said frame.

5. A knitting machine in accordance with claim 1 in which said variable speed drive means is mounted on said frame, in which said pulley and belt system includes a transfer pulley mounted coaxially of the pivot point of said lever, and in which said throttle operating means comprises a rod connected to said throttle and pivotally connected to said lever.

6. A knitting machine comprising:

a frame;

a knitting head and cylinder mounted on said frame in position to receive knitting filament fed thereto from above said cylinder and to deliver a tube of knitted fabric downwardly out of said cylinder; and take down means mounted on said frame below said cylinder for tensioning said knitted tube and drawing it downwardly out of said cylinder said take-down means comprising:

a lever pivotally mounted on said frame;

a variable speed drive means having a throttle;

a pair of pinch rolls mounted on said lever for engaging said knitted tube and drawing it downwardly out of said cylinder;

a pulley and belt system interconnecting said drive means and said pinch rolls;

means for variably biasing said pinch rolls away from said cylinder; and means for operating said drive means throttle to increase the speed of said drive means upon downward excursions of said throttle and decrease the speed of said drive means upon upward excursions of said throttle.

7. A knitting machine in accordance with claim 6 and further comprising a break-away knitting filament accumulator interposed in the path of knitting filament flow between knitting filament feed means and said knitting head, said accumulator comprising:

an accumulator frame;

a block slidably mounted on said accumulator frame for reciprocation toward and away from one end thereof;

a first array of filament pulleys mounted at said one end of said accumulator frame;

a second array of filament pulleys mounted on said slidable block whereby said knitting filament may be trained in a serpentine path passing alternately around pulleys on said first and second arrays;

detent retainer means mounted on the other end of said accumulator frame and releasably engaging said slidable block to retain it adjacent said other end until the tension on said knitting filament exceeds a preselected value.

8. A knitting machine in accordance with claim 7 and further comprising:

a lubricating liquid tank mounted on said frame through which knitting filament is passed during its feed to said knitting cylinder;

said break-away knitting filament accumulator being mounted on said tank, and one of the pulleys in said first array being positioned to feed filament from said accumulator to said tank.

9. A knitting machine in accordance with claim 6 in which said variable speed drive means is mounted on said lever and in which said throttle operating means comprises a rod connected to said throttle and pivotally connected to said frame.

10. A knitting machine in accordance with claim 6 in which said variable speed drive means is mounted on said frame, in which said pulley and belt system includes a transfer pulley mounted coaxially of the pivot point of said lever, and in which said throttle operating means comprises a rod connected to said throttle and pivotally connected to said lever.

11. A knitting machine in accordance with claim 6 and further comprising:

power means mounted on said frame for operating said knitting head and said variable speed drive means;

and power train means connecting said power means to said knitting head, and said knitting head to said variable speed drive means.

* * * * *